United States Patent [19]

Klein

[11] Patent Number: 4,674,355

[45] Date of Patent: Jun. 23, 1987

[54] CRANKHANDLE STRUCTURE

[75] Inventor: Thomas A. Klein, Plainwell, Mich.

[73] Assignee: Lear Siegler, Inc., Kalamazoo, Mich.

[21] Appl. No.: 778,608

[22] Filed: Sep. 20, 1985

[51] Int. Cl.[4] ..... G05G 1/00

[52] U.S. Cl. ..... 74/543; 74/545; 74/553; 384/543

[58] Field of Search ..... 74/545, 594.4, 594.1, 74/543, 548, 557, 560, 553; 384/609, 615, 617, 543, 544, 545, 546, 622, 618, 456, 457, 458, 125; 403/26, 258, 260; 16/114, 117, 112, DIG. 12, DIG. 24, DIG. 30, 121

[56] References Cited

U.S. PATENT DOCUMENTS

| | | | |
|---|---|---|---|
| 298,079 | 5/1884 | Gendron | 74/594.4 |
| 428,919 | 5/1890 | Latta | 384/544 |
| 558,557 | 4/1896 | Hall | 74/594.4 |
| 564,099 | 7/1896 | Pritchett | 74/543 X |
| 567,125 | 9/1896 | Devoll | 384/457 |
| 610,923 | 9/1898 | Scheeren | 384/545 X |
| 667,063 | 1/1901 | Clevenger | 384/545 |
| 698,557 | 4/1902 | Roberts | 384/544 |
| 751,496 | 2/1904 | Gode | 74/543 X |
| 1,189,606 | 7/1916 | Miller | 74/545 X |
| 1,254,610 | 2/1918 | Ledig | 74/594.4 |
| 1,375,003 | 4/1921 | Ingels | 74/594.4 |
| 2,298,283 | 10/1942 | Duffy | 74/594.4 |
| 2,322,004 | 6/1943 | Fast | 384/125 |
| 3,047,700 | 7/1962 | Bailey | 16/DIG. 30 X |
| 3,315,540 | 4/1967 | Baumgartner | 74/545 X |
| 4,000,539 | 1/1977 | Neyer | 16/121 |
| 4,338,829 | 7/1982 | Ozaki | 74/594.4 |

FOREIGN PATENT DOCUMENTS

| | | | |
|---|---|---|---|
| 163876 | 8/1949 | Austria | 74/594.1 |
| 322067 | 6/1920 | Fed. Rep. of Germany | 74/594.4 |
| 472102 | 7/1914 | France | 74/545 |
| 13242 | of 1894 | United Kingdom | 74/594.1 |

*Primary Examiner*—Gary L. Smith
*Assistant Examiner*—Rodney M. Lindsey
*Attorney, Agent, or Firm*—Gordon W. Hueschen

[57] ABSTRACT

A crankhandle assembly has a cylindrically-hollow handle member rotatably mounted on a shaft or core element. The shaft has complementary stepped contours at each end and the handle has bearing cups at each end positioned to form with said stepped contours a ball bearing race, a thrust bearing, and a handle race. The bearing cup elements are centered in the handle by axially and radially disposed fins.

6 Claims, 11 Drawing Figures

CRANKHANDLE STRUCTURE

FIELD OF INVENTION AND PRIOR ART

The invetnion relates to a crankhandle assembly or structure and is particularly directed to improvements which permit the structure to be made of plastic material, such as high impact plastics, for example, fiber-reinforced nylon.

Many modern devices, such a desks, have means for raising or lowering portions thereof, such as the working surface of a desk. Such means requires a crank readily accessible to the user which is simple, rugged, and easily operable. It also requires a handle that rotates freely and is not subject to canting or rocking as a result of improper usage or wear.

The crankhandle assemblies heretofore available do not meet these requirements. It is an object of the invention, therefore, to provide a crankhandle assembly which does.

SUMMARY OF THE INVENTION

The invention relates to improvements in a crankhandle assembly comprising a crank member having a hub member, an arm member, a handle-receiving member, and a shaft member projecting axially from said handle-receiving member to a shaft head member, and a cylindrically-hollow handle member rotatably mounted on said shaft member and retained thereon by said head member;

in which:

said handle-receiving member has a stepped male contour comprising a set of alternating rises and steps, and the head member of said shaft member has a like stepped male contour comprised of a second set of alternating rises and steps but in reverse of that on said handle-receiving member;

said cylindrically-hollow handle member has at each end a stepped female contour having rises and steps corresponding to the rises and steps in said stepped male contours of said handle-receiving member and said head member;

the innermost of said male and female rises cooperate with the innermost of said female steps to form at each end of said cylindrically-hollow handle member a ball bearing race adapter to receive and hold ball bearings;

the outermost of said male and female steps are juxtaposed concentric cylindrical surfaces forming at each end a handle race to keep said cylindrically-hollow handle member radially centered on said shaft;

two of said male and female rises are juxtaposed thereby forming at each end of said cylindrically-hollow handle member a thrust bearing to keep said cylindrically-hollow handle member axially centered; and said handle races, said thrust bearings, and said ball-bearing races compensating for any uneven and erratic thrust developed by differing applications of force to the same in cranking by the operator.

The invention also comprises one or more further features in which said female stepped contours are comprised of discrete bearing cup members inserted into each end of said handle member, each of which has an inner annular transverse wall constituting said innermost female rise and a cylindrical wall which has an outer cylindrical surface contiguous with the inner cylindrical surface of said cylindrically-hollow handle member, an outer end inset from the outer end of said cylindrically-hollow handle member constituting said female rise which forms a part of said thrust bearing, and an inner cylindrical surface constituting said innermost female step; and in which said handle member has axially-disposed radial fins which project radially from adjacent the inner surface of said handle member to adjacent said shaft member and extend axially from one bearing cup member to the other and act to space the same so that the annular wall and the inner cylindrical surface of each said bearing cups is in position to function as parts of said ball bearing races, and the ends of the cylindrical walls of each said bearing cup member are in position to function as parts of said thrust bearings.

In its further aspects, the invention also relates to the combination, in a crankhandle assembly, of:

a crank member having an insert-engaging portion and a handle-engaging portion for engaging a handle member; said insert-engaging portion having a recess adapted to receive an insert to be retained therein; said handle-engaging portion having a side with a core-receiving recess therein for receiving a cylindrical core element; the said core-receiving side of said handle-engaging portion of said crank member having a stepped annular contour with steps and rises therein, one rise being an outer abutment adapted to close a bearing race in said handle member, a second rise being adapted to constitute an inner stop for a bearing cup element in said handle member, and an outer step being adapted to constitute a part of a handle race for rotation of said handle member thereabout; and a cylindrically-hollow handle member adapted to fit over said outer step of said crank member at the handleengaging portion thereof for rotation thereabout and comprising internal fins for spacing bearing cup elements at the ends and interior thereof; circular bearing cup elements at both ends of said fins within said cylindrically-hollow handle member; each of said bearing cup elements having an inner annular wall adapted, along with a wall of said core element, to constitute a part of a bearing race within said handle member, and having a circular central opening therein for receiving a cylindrical handle core element; and having a peripheral extension thereof beyond said inner annular wall for contacting, at the inner end of said handle member, the stop constituted by said second rise on said handleengaging portion of said crank member and, at the outer end of said handle member, for contacting a vertical stop wall of a cap on said core element; and a cylindrical core element having a circumference adapted to correspond with the circular central openings of said bearing cup elements, an inner circular opening between said fins on said cylindrically hollow member and said core receiving recess, and comprising an annular cap of greater circumference with two rises thereon, one of which lastnamed rises being designed to complete, together with a wall of said core element and the annular wall of said bearing cup element, an outer bearing race, and the second of which last-named rises is designed to contact the extension of the bearing cup element located at the outer end of said handle member; and ball bearings in said bearing races and securing means securing said core element of said handle member in said core-receiving recess in the handle-engaging portion of said crank member.

This further aspect of the invention also comprises one or more further features in which said securing means is a screw and said handle-engaging portion of said crank member has a recess therein opposed to said core-receiving recess and adapted to receive said screw for securing said core element in said core-receiving recess;

in which said cap of said core element has a recess therein having a slot therein for holding said core element against rotation when it is tightened in said core receiving recess by said screw; and in which each of said bearing cup elements comprises a cylindrically-hollow portion which constitutes said peripheral extension and extends outward axially from the rim of said inner annular wall and has an outer cylindrical surface contiguous with and concentric with the inner cylindrical surface of said cylindrically-hollow handle member and a concentric inner cylindrical surface constituting the innermost of said female steps and part of the ball bearing race.

The invention may also comprise one or more further features in which said fins extend radially inward from the inner cylindrical surface of said cylindrically-hollow handle member to or substantially to abutment with the surface of said cylindrical core element and have enlarged middle portions which, advantageously, have opposed semicircular contours.

DETAILED DESCRIPTION OF A PREFERRED EMBODIMENT

Figures 1, 2, 3, 4, 5, 6, 7, 8, 9, 10, 11:
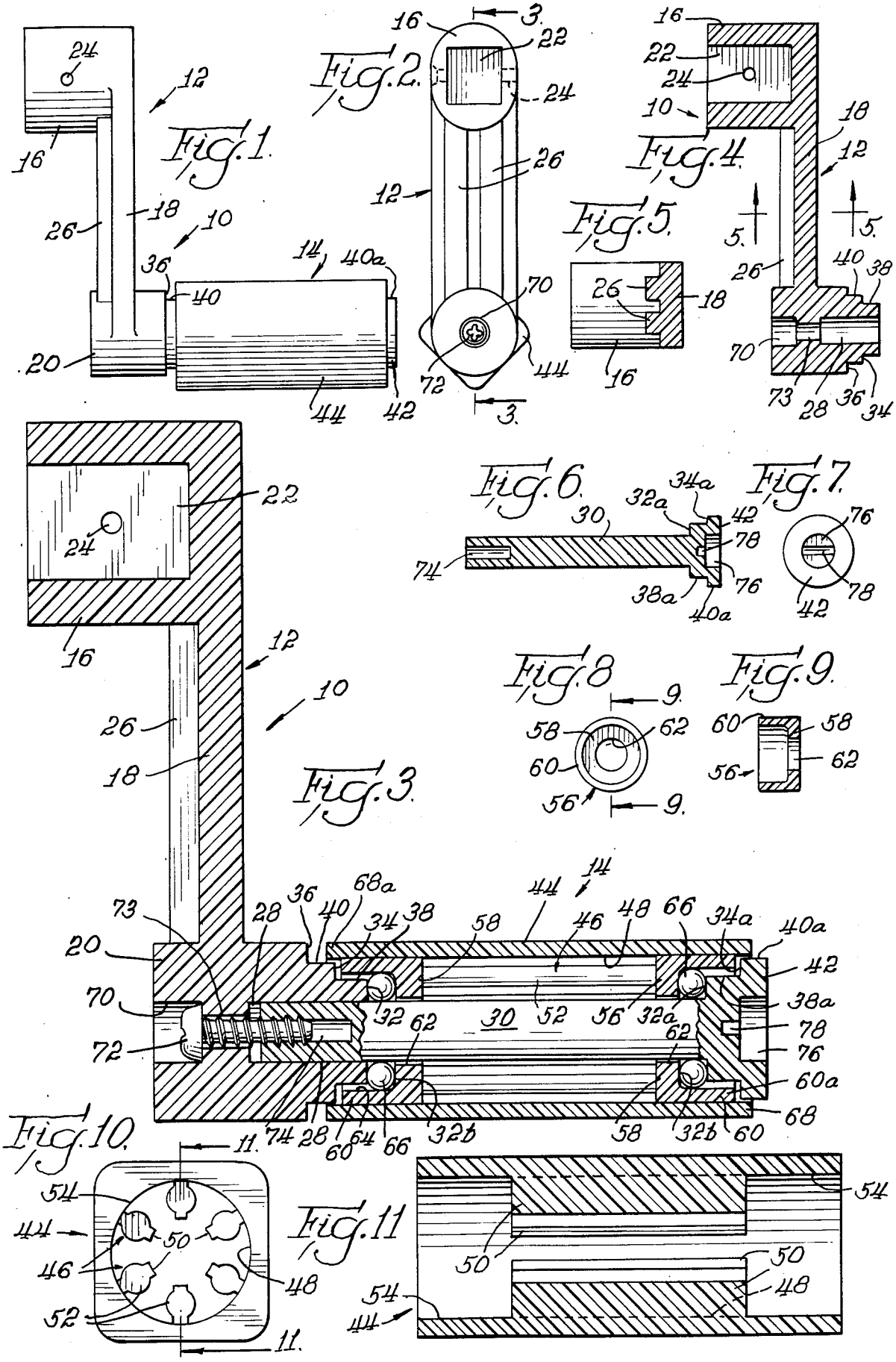
FIG. 1 is a side elevation of a crank handle assembly of the invention.
FIG. 2 is a front elevation;.
FIG. 3 is a cross section taken on line 3—3 of FIG. 2.
FIG. 4 is a detail in cross section taken on line 3—3 of FIG. 2.
FIG. 5 is a cross section taken on line 5—5 of FIG. 4.
FIG. 6 is a detail in cross section of the shaft or core element shown in FIG. 3.
FIG. 7 is an end view of FIG. 6.
FIG. 8 is an end view of a bearing cup shown in FIG. 3.
FIG. 9 is a cross section taken on line 9—9 of FIG. 8.
FIG. 10 is a detail of a cylindrically-hollow handle member shown in FIG. 3.
FIG. 11 is a cross section taken on line 11—11 of FIG. 10.

In the drawings, 10 designates a crankhandle assembly according to the invention, having a crank 12 and handle assembly 14. The crank 12 comprises a hub 16 at one end of arm 18 and a handle-receiving member 20 at the other end of arm 18. The hub 16 has an axial recess 22 for receiving a square drive shaft (not shown). The recess 22 has a threaded hole 24 for receiving a set screw to fasten the hub 16 to the drive shaft and arm 18 has radial reinforcing ribs 26.

The handle-receiving member 20 has an axially-disposed recess 28 for receiving the shaft 30 which is the core element of the handle assembly 14. Coaxial with the recess 28 are rises 32, 34, and 36 alternating with steps 38 and 40, thus giving the handle-receiving side a stepped contour.

The end of shaft 30 has a cap or head 42 with a like stepped contour but in the reverse, rises 32*a* and 34*a* corresponding to rises 32 and 34, respectively, and steps 38*a* and 40*a*, to steps 38 and 40. The two stepped contours thus have right- and left-hand symmetry. The cap 42, however, does not have a rise corresponding to the rise 36 but one can be provided if desired. Also, the rise 36 can be omitted if desired.

The handle assembly 14 is composed of a cylindrical-lyhollow handle member 44 having axial fins 46 which project radially inwardly from the inner cylindrical surface 48 of the handle member 44. The fins extend inwardly to a point where they abut or substantially abut the shaft or core element 30 and thus provide arcuate surfaces 50 delineating a circular opening through which the shaft or core element 30 projects. The fins 46 have enlarged mid-portions which advantageously have an opposed semi-circular contour as shown at 52.

The axial fins 46 terminate short of the ends of the handle member 44 leaving a cylindrical opening 54 at each end. Seated in these openings are bearing cups elements 56 which have an annular, transverse wall 58 which merges with a cylindrical wall 60. The annular walls 58 abut the ends of the fins 46 and the cylindrical walls 60 abut the inner cylindrical surface 48 of the handle member 44. The annular wall 58 has a circular central opening 62 corresponding to the circumference of the shaft or core element 30 and extends down below the cylindrical wall 60 sufficiently to provide rises 32*b* complementary to rises 32 and 32*a* and spaced therefrom and from the inner surface 64 of the cylindrical wall 60 distances substantially equal to the diameter of a ball bearing 66 so that rises 32 and 32*a* form, with rises 32*b* and the inner wall 64, a bearing race for ball bearings 66.

The cylindrical walls 60 extend out beyond the rises 32 and 32*a* to provide extensions 60*a* which overlie steps 38 and 38*a* in loose abutment with rises 34 and 34*a* thus providing a thrust bearing to prevent substantial axial movement of the handle assembly 14 on the shaft 30.

The inner cylindrical surface 48 of the handle member 44 extends beyond the ends of the bearing cups 56 to provide extensions 68 and 68*a* which overlie steps 40 and 40*a*, respectively, in loose abutment and form therewith a handle race which minimizes any tendency toward rocking of the handle member 44.

The handle-receiving member has a recess 70 opposed to and coaxial with the recess 28 to receive a self-threading screw 72 which is threaded through bore 73 into bore 74 of the shaft 30 to secure the shaft 30 in recess 28. The cap 42 has circular indentation 76 therein having a transverse slot 78 for the purpose of holding the shaft 30 immobile when it is being drawn into the recess 28 by screw 72.

The exterior configuration of the handle member 44 is shown as square, but it is understood that the outer shape is not critical to the invention and that any shape desired can be used.

The various parts of the crank handle assembly of the invention thus described are especially designed and suited for plastic molding techniques and the several parts can be made of any suitable plastic strong enough for the purpose. High impact plastics and reinforced plastics such as, for example, fiber-reinforced nylon, are suitable. Although the invention is not limited as to material, the design of the several parts lends them to the use of non-metallic components. Thus, all the parts of the crank handle assembly of the invention, save the ball bearings 66 and the screw 72, can, for example, advantageously be made of fiber-reinforced nylon.

It is to be understood that the invention is not to be limited to the exact details shown and described, as various modifications and equivalents will be apparent to one skilled in the art.

I claim:

1. In a crankhandle assembly comprising a crank member having a hub member, an arm member, a handle-receiving member, and a shaft member projecting axially from said handle-receiving member to a shaft head member, and a cylindrically-hollow handle member rotatably mounted on said shaft member and retained thereon by said head member, in which said hub member, said arm member, said handle-receiving member, said shaft member and said cylindrically-hollow handle member are all made of high-impact plastic;

the improvement in which:

said handle-receiving member has a stepped male contour comprising a set of alternating rises and steps, and the head member of said shaft member has a like stepped male contour comprised of a second set of alternating rises and steps but in reverse of that on said handle-receiving member;

said cylindrically-hollow handle member has at each end a stepped female contour having rises and steps corresponding to the rises and steps in said stepped male contours of said handle-receiving member and said head member;

the innermost of said male and female rises cooperate with the innermost of said female steps to form at each end of said cylindrically-hollow handle member a ball bearing race adapted to receive and hold ball bearings;

ball bearings in each said ball bearing race;

the outermost of said male and female steps are juxtaposed concentric cylindrical surfaces forming at each end a handle race to keep said cylindrically-hollow handle member radially centered on said shaft;

two of said male and female rises are juxtaposed thereby forming at each end of said cylindrically-hollow handle member a thrust bearing to keep said cylindrically-hollow handle member axially centered, said handle races, said thrust bearings, and said ball-bearing races compensating for any uneven and erratic thrust developed by differing applications of force to the same in cranking by the operator; said female stepped contours are comprised of discrete bearing cup members inserted into each end of said handle member, each of which has an inner annular transverse wall constituting said innermost female rise and a cylindrical wall which has an outer cylindrical surface contiguous with the inner cylindrical surface of said cylindrically-hollow handle member, an outer end inset from the outer end of said cylindrically-hollow handle member constituting said female rise which forms a part of said thrust bearing, and an inner cylindrical surface constituting said innermost female step; and; said handle member has, as an integral part thereof, axially-disposed radial fins which project radially from the inner surface of said handle member to adjacent said shaft member and extend axially from one bearing cup member to the other and act to space the same so that the annular wall and the inner cylindrical surface of each said bearing cups is in position to function as parts of said ball bearing races, and the ends of the cylindrical walls of each said bearing cup members are in position to function as parts of said thrust bearings; and said fins are integral with and extend radially inward from the inner cylindrical surface of said cylindrically-hollow handle member substantially to abutment with the surface of said cylindrical core element.

2. A crankhandle assembly of claim 1 in which said fins have enlarged mid-portions.

3. A crankhandle assembly of claim 2 in which said enlarged mid-portions which have opposed semi-circular contours.

4. In a crankhandle assembly, the combination of:

a crank member having an insert engaging portion and a handle-engaging portion for engaging a handle member; said insert-engaging portion having a recess adapted to receive an insert to be retained therein; said handle-engaging portion having a side with a core-receiving recess therein for receiving a cylindrical core element; the said core receiving side of said handle-engaging portion of said crank member having a stepped annular contour with steps and rises therein, one rise being an outer abutment adapted to close a bearing race in said handle member, a second rise being adapted to constitute an inner stop for a bearing cup element in said handle member, and an outer step being adapted to constitute a part of a handle race for rotation of said handle member thereabout; and a cylindrically-hollow handle member adapted to fit over said outer step of said crank member at the handle-engaging portion thereof for rotation thereabout and comprising internal fins for spacing bearing cup elements at the ends and interior thereof; circular bearing cup elements at both ends of said fins within said cylindrically-hollow handle member; each of said bearing cup elements having a radial wall and an inner axial annular wall adapted, along with said one rise and a wall of said core element, to constitute a bearing race within said handle member, and a circular central opening therein for receiving said cylindrical handle core element; and having peripheral extensions of said inner axial walls, one of which is in loose abutment with, at the inner end of said handle member, the stop constituted by said second rise on said handle-engaging portion of said crank member and the other of which is in loose abutment with, at the outer end of said handle member, a vertical stop wall of a cap on said core element;

a cylindrical core element having a circumference adapted to correspond with the circular central openings of said bearing cup elements, an inner circular opening between said fins on said cylindrically hollow handle member and said core receiving recess, and comprising an annular cap of greater circumference with two rises thereon, one of which last-named rises forming, together with the circumference of said core element and the axial and radial walls of said bearing cup element, an outer bearing race, and the second of which last-named rises contacts the extension of the bearing cup element located at the outer end of said handle member;

in which the above elements and members are made of high-impact plastic;

ball bearings in said bearing races and securing means securing said core element of said handle member in said core receiving recess in the handle-engaging portion of said crank member; and in which said fins are integral with and extend radially inward from the inner cylindrical surface of said cylindrically-hollow handle member substantially to abutment with the surface of said cylindrical core element.

5. A crankhandle assembly of claim 4 in which said fins have enlarged mid-portions.

6. A crankhandle assembly of claim 5 in which said enlarged mid-portions have opposed semicircular contours.

* * * * *

UNITED STATES PATENT AND TRADEMARK OFFICE

CERTIFICATE OF CORRECTION

PATENT NO. : 4,674,355

DATED : June 23, 1987

INVENTOR(S) : Thomas A. Klein

It is certified that error appears in the above-identified patent and that said Letters Patent is hereby corrected as shown below:

Title Page, [56] References Cited, U.S. Patent Documents, line 11, Col. 2; "2/1918" should read -- 1/1918-- (original Letters Patent)
Col. 1, line 5; "invetnion" should read -- invention --
Col. 1, line 10; "a" should read -- as --
Col. 2, line 34; "leengaging" should read -- le-engaging --
Col. 2, line 47; "leengaging" should read -- le-engaging --
Col. 2, line 56; "lastnamed" should read -- last-named --
Col. 4, lines 4&5; "cylindricallyhollow" should read -- cylindrically-hollow --
Col. 6, line 8; delete "which" (Response dated 11/28/86, pg. 5)
Col. 8, line 4; "semicircular" should read -- semi-circular --

Signed and Sealed this

Nineteenth Day of January, 1988

*Attest:*

DONALD J. QUIGG

*Attesting Officer*

*Commissioner of Patents and Trademarks*